US008689970B2

(12) United States Patent
Stutzman

(10) Patent No.: US 8,689,970 B2
(45) Date of Patent: Apr. 8, 2014

(54) GLASSES HEADBAND COVER METHOD, APPARATUS, AND SYSTEM

(76) Inventor: Kelly Stutzman, Hamden, CT (US)

( * ) Notice: Subject to any disclaimer, the term of this patent is extended or adjusted under 35 U.S.C. 154(b) by 0 days.

(21) Appl. No.: 13/469,862

(22) Filed: May 11, 2012

(65) Prior Publication Data

US 2013/0001104 A1 Jan. 3, 2013

Related U.S. Application Data

(60) Provisional application No. 61/504,044, filed on Jul. 1, 2011.

(51) Int. Cl.
*B65D 85/38* (2006.01)
*G02C 3/02* (2006.01)

(52) U.S. Cl.
USPC ..... 206/5; 2/13

(58) Field of Classification Search
USPC ..... 206/5, 37, 38; 2/209.13, 10, 12, 13, 422
See application file for complete search history.

(56) References Cited

U.S. PATENT DOCUMENTS

| | | | | | |
|---|---|---|---|---|---|
| D200,735 | S | * | 3/1965 | Mitchell | D16/309 |
| 3,545,603 | A | * | 12/1970 | Warsager | 206/5 |
| 4,520,510 | A | | 6/1985 | Daigle | |
| 4,712,254 | A | | 12/1987 | Daigle | |
| 4,751,746 | A | * | 6/1988 | Rustin | 2/13 |
| 4,811,430 | A | | 3/1989 | Janusz | |
| 4,852,189 | A | | 8/1989 | Duggan | |
| 4,953,695 | A | * | 9/1990 | Tallman | 206/5 |
| 5,102,216 | A | * | 4/1992 | Mitchell | 351/156 |
| 5,113,529 | A | * | 5/1992 | Carr | 2/13 |
| 5,129,106 | A | * | 7/1992 | Liou | 2/411 |
| 5,151,778 | A | | 9/1992 | Conley | |
| 5,299,682 | A | * | 4/1994 | Tatar | 206/5 |
| 5,553,321 | A | | 9/1996 | Cassel | |
| 5,593,024 | A | * | 1/1997 | Seiler | 206/5 |
| 5,687,837 | A | | 11/1997 | Seiler | |
| 5,735,393 | A | * | 4/1998 | Shiue et al. | 206/5 |
| 5,771,500 | A | * | 6/1998 | Mayes | 2/452 |
| 6,038,706 | A | * | 3/2000 | Seiler | 2/426 |
| 6,115,843 | A | * | 9/2000 | Travalgia | 2/171 |
| 6,237,159 | B1 | * | 5/2001 | Martin | 2/209.12 |
| 6,647,554 | B1 | * | 11/2003 | Yan | 2/209.13 |
| 6,739,718 | B1 | | 5/2004 | Jung | |
| 6,820,739 | B1 | * | 11/2004 | Spitzer | 206/5 |

(Continued)

FOREIGN PATENT DOCUMENTS

GB 2175791 A 12/1986

*Primary Examiner* — Jacob K Ackun
(74) *Attorney, Agent, or Firm* — Michael A. Blake

(57) ABSTRACT

A cover for a pair of glasses comprising: a sleeve, the sleeve comprising: a main body portion, the main body portion sized to generally be able to enclose the lens portion of a pair of glasses; a first stem portion, the first stem portion configured to generally enclose at least a portion of the glasses' first stem; a second stem portion, the second stem portion configured to generally enclose at least a portion of the glasses' second stem; an opening located generally in the main body portion and configured to allow entry and exit of the glasses with respect to the cover. A method of using an eyeglass cover and glasses as a headband, the method comprising: inserting glasses into an eyeglass cover; placing the glasses and eyeglass cover on a user's head, generally above the forehead, with the stems of the glasses over the user's ears, such that the cover and glasses look and act as a headband.

5 Claims, 9 Drawing Sheets

(56) References Cited

U.S. PATENT DOCUMENTS

| | | | | |
|---|---|---|---|---|
| 7,096,514 | B2 * | 8/2006 | Khulusi | 2/430 |
| 7,131,148 | B1 * | 11/2006 | Traumer | 2/426 |
| 7,201,479 | B2 * | 4/2007 | Spitzer | 351/158 |
| 2004/0149597 | A1 * | 8/2004 | Francia | 206/5 |
| 2010/0095977 | A1 | 4/2010 | Schmitz | |
| 2011/0314580 | A1 * | 12/2011 | Vach | 2/10 |

* cited by examiner

GLASSES HEADBAND COVER METHOD, APPARATUS, AND SYSTEM

CROSS-REFERENCES

This patent application claims the benefit of provisional patent application Ser. No. 61/504,044 by Kelly Stutzman, entitled "Headband Eyeglass Cover", filed on Jul. 1, 2011, the entire contents of which are fully incorporated by reference herein.

TECHNICAL FIELD

The present invention relates generally to a cover for eyeglasses and/or sunglasses and more particularly to a cover for eyeglasses and/or sun glasses, which can be worn as a headband and may be used as a compact, non-bulky carrying case when glasses need to be stored.

BACKGROUND

As long as there have been eyeglasses or sunglasses (the term glasses will refer to both eyeglasses and sunglasses), there has been a problem of what to do with the glasses when not using them. Some people simply prop the glasses on top of their head, however these glasses are often not secure, and can get dirty or smudged. Some people have glasses' cords connected to the stems of their glasses, and hang the glasses around their neck. However, these cords are often not stylish, and the glasses can be in a person's way when swinging about his or her neck. Some people store their glasses in hard cases, but these cases may be bulky and may not fit in many of the compartments or places that people choose to store their glasses in.

Thus there is a need for a device that can hold glasses that will overcome the above listed and other disadvantages.

SUMMARY

The disclosed invention relates to a cover for a pair of glasses comprising: a sleeve, the sleeve comprising: a main body portion, the main body portion sized to generally be able to enclose the lens portion of a pair of glasses; a first stem portion, the first stem portion configured to generally enclose at least a portion of the glasses' first stem; a second stem portion, the second stem portion configured to generally enclose at least a portion of the glasses' second stem; an opening located generally in the main body portion and configured to allow entry and exit of the glasses with respect to the cover.

The invention also relates to a method of using an eyeglass cover and glasses as a headband, the method comprising: inserting glasses into an eyeglass cover; placing the glasses and eyeglass cover on a user's head, generally above the forehead, with the stems of the glasses over the user's ears, such that the cover and glasses look and act as a headband.

In addition, the invention relates to an eyeglass cover system, the system comprising: a pair of glasses; a sleeve, the sleeve comprising: a main body portion, the main body portion sized to generally be able to enclose the lens portion of the glasses; a first stem portion, the first stem portion configured to generally enclose at least a portion of the glasses' first stem; a second stem portion, the second stem portion configured to generally enclose at least a portion of the glasses' second stem; an opening located generally in the main body portion and configured to allow entry and exit of the glasses with respect to the cover.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
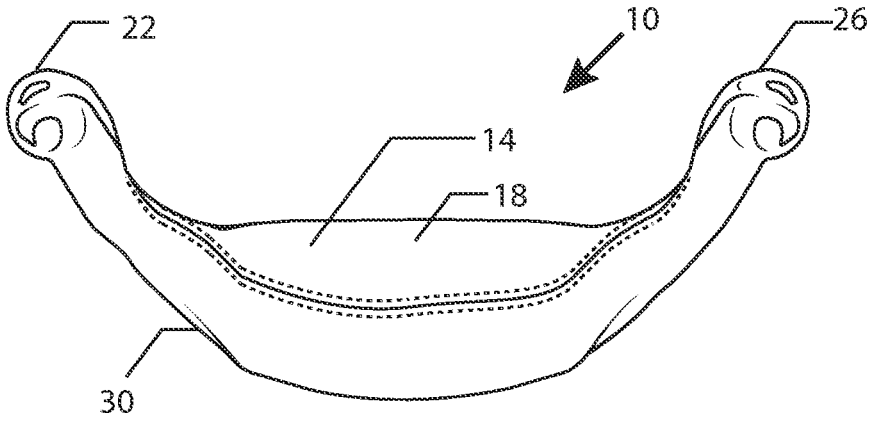
FIG. 1 is a front view of the glasses cover.

FIG. 1 shows an embodiment of the disclosed cover 10. The invention comprises a sleeve 14 made out of fabric such as, but not limited to: nylon, wool, spandex, cotton, blends of materials. The sleeve 14 has a main body portion 18 and two stem portions 22, 26. There is a single flap 30 on the main body portion. The flap 30 allows access to the interior of the sleeve 14. Alternatively, instead of a flap, there may be an opening that can be closed with a zipper, an opening closeable with Velcro, a slot with buttons, snaps, etc. The material may have a design, such as but not limited to decorative designs that head bands may have. Various designs that may be on the material include but are not limited to a tiger stripe pattern, stripes, patterns of geometric shapes, images of sports mascots, images of famous characters, or popular words or phrases printed on the material. The opening 30 allows a user to place a pair of glasses in the sleeve, with the lenses in the main body 18, and the glasses' stems going into each of the stem portions 22, 26. In one embodiment, the cover may have an inner lining that is configured to protect the glasses from scratches or other damage.

Figure 2:
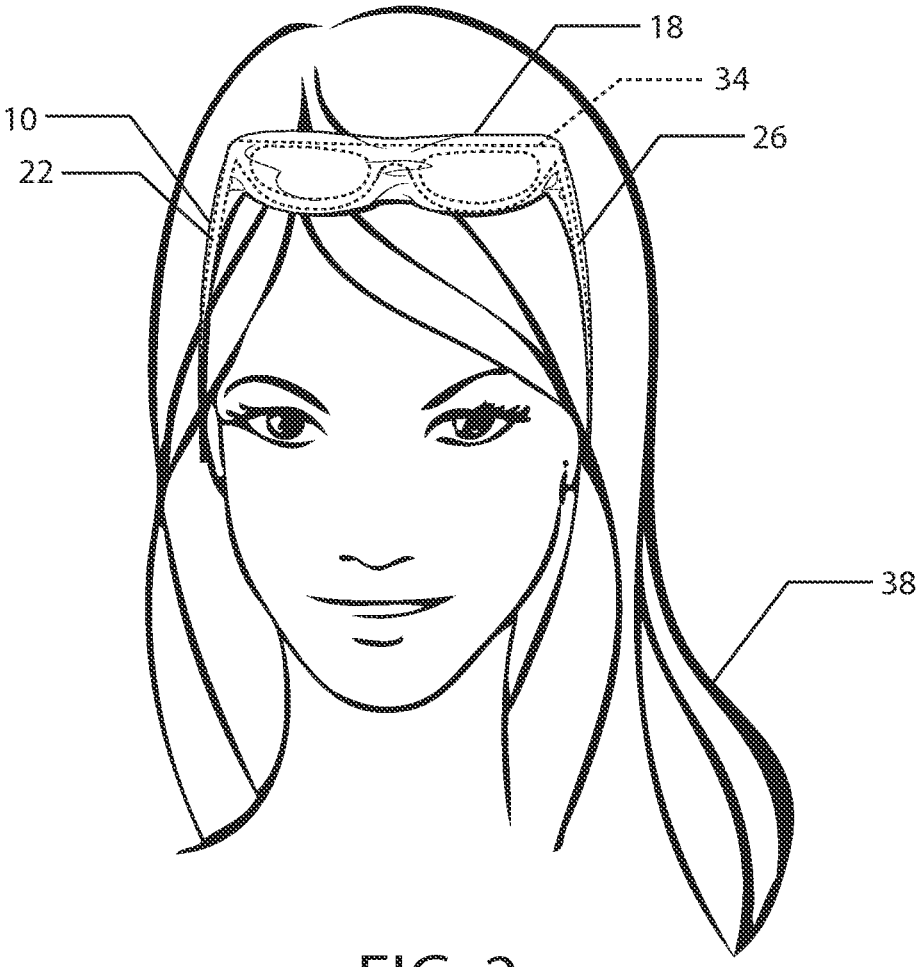
FIG. 2 is a front view of the glasses cover shown being worn as a headband.
Figure 7:
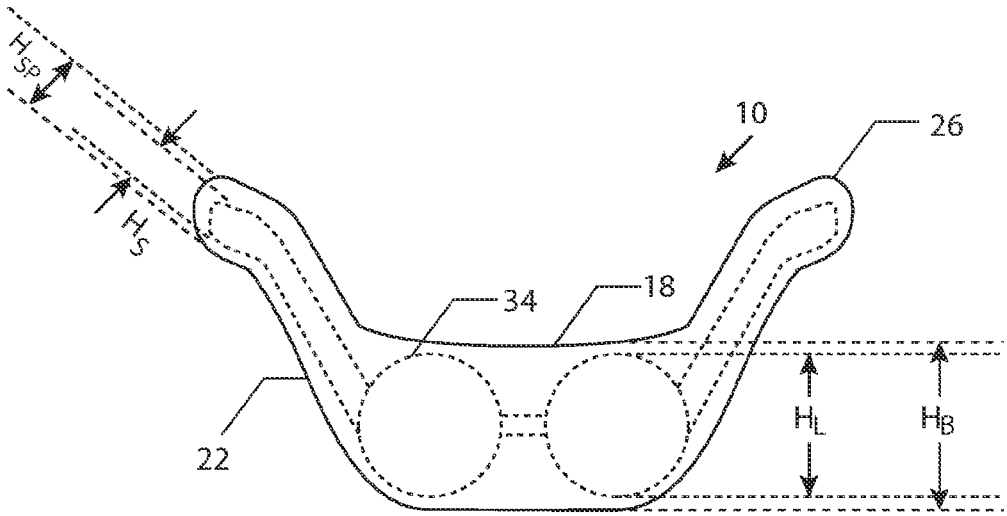
FIG. 7 is a front view of the glasses cover.

FIG. 2 shows the glasses 34 inside the cover 10. Now a user 38 can place the glasses 34 (located inside the cover 10) on top of her head, but instead of appearing as glasses on top of the head (which women often do in order to hold their hair back from their face), the glasses inside the sleeve 14 appear to be a decorative headband. Now referring to FIG. 7, the main body portion 18 may have a height $H_B$ that is generally the same height dimensions of the of the lens portion of the glasses $H_L$, or $H_B$ may be just slightly larger than $H_L$. The stem portions 22, 26 may have a height dimension $H_{SP}$ that is generally equal to the height dimension of the stems $H_S$ of the glasses.

Figure 8:
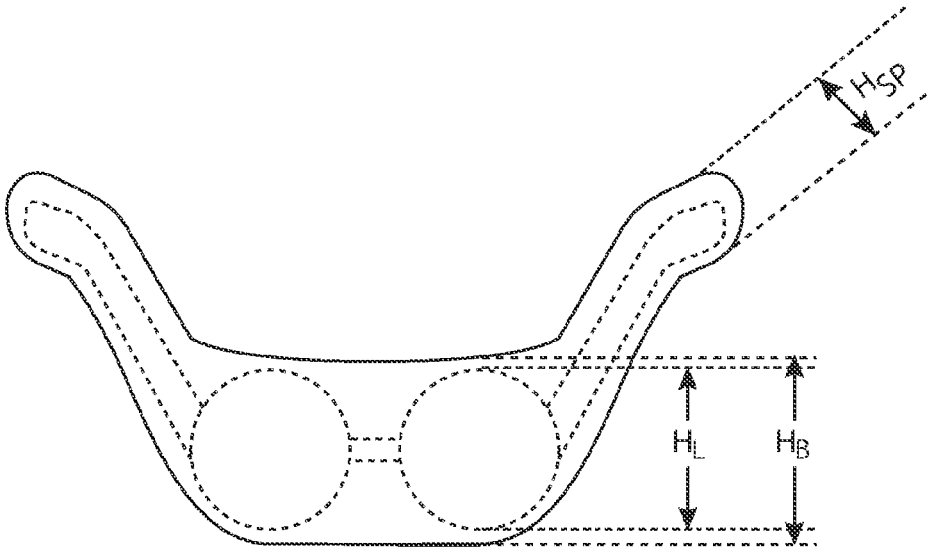
FIG. 8 is a front view of a generally constant height embodiment of the glasses cover.

Another embodiment of the cover 42 is shown in FIG. 8. The main body portion 18 may have a height $H_B$ that is generally the same height dimensions as the lens portion of the glasses $H_L$, or $H_B$ may be just slightly larger than $H_L$. However, in this embodiment, the stem portions 22, 26 may have a height dimension $H_{SP}$ that is generally equal to $H_B$. Thus, the embodiment in FIG. 8 will look more like a typical headband that has a generally constant width along its length.

Figure 3:
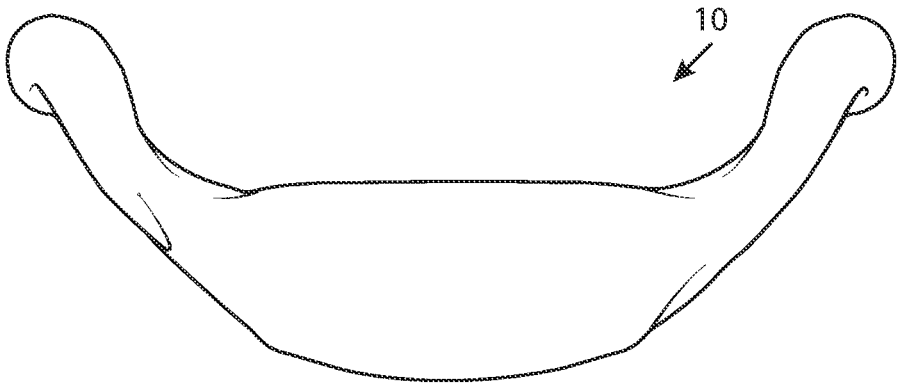
FIG. 3 is a top view of the glasses cover.
Figure 4:
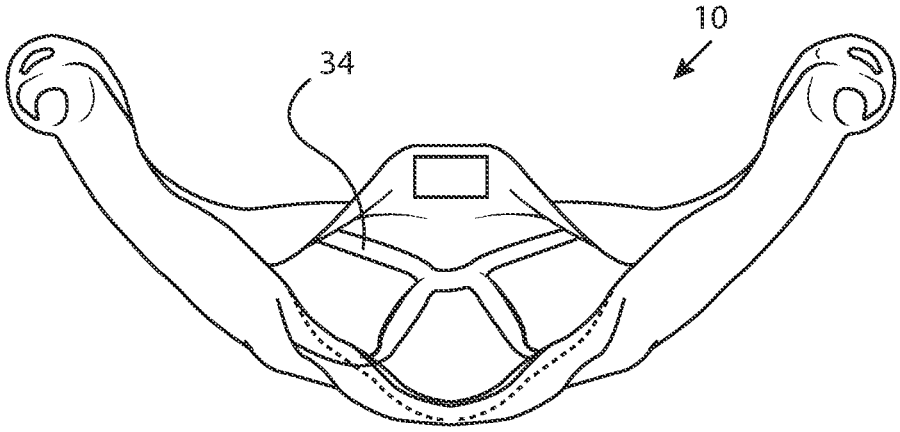
FIG. 4 is a top view of the glasses cover with glasses shown inside the glasses cover.
Figure 5:
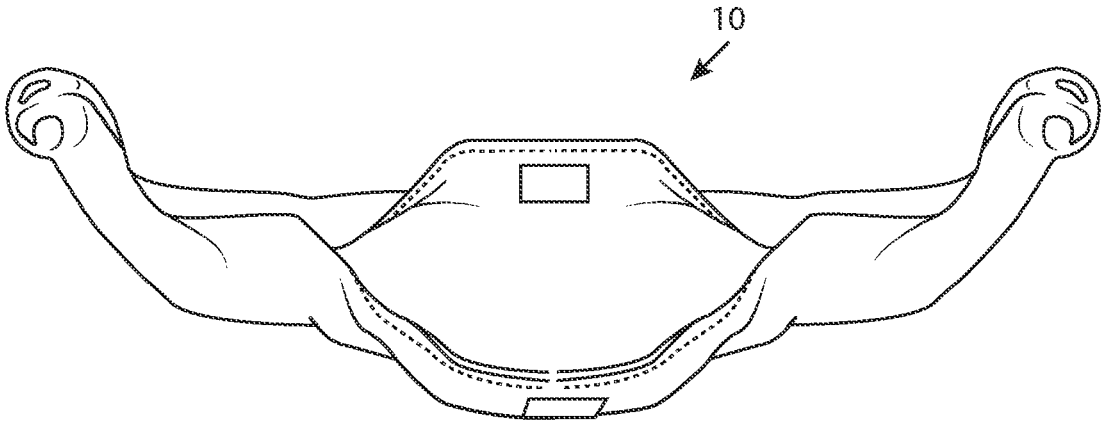
FIG. 5 is a top view of the glasses cover with the opening in an opened position.
Figure 6:
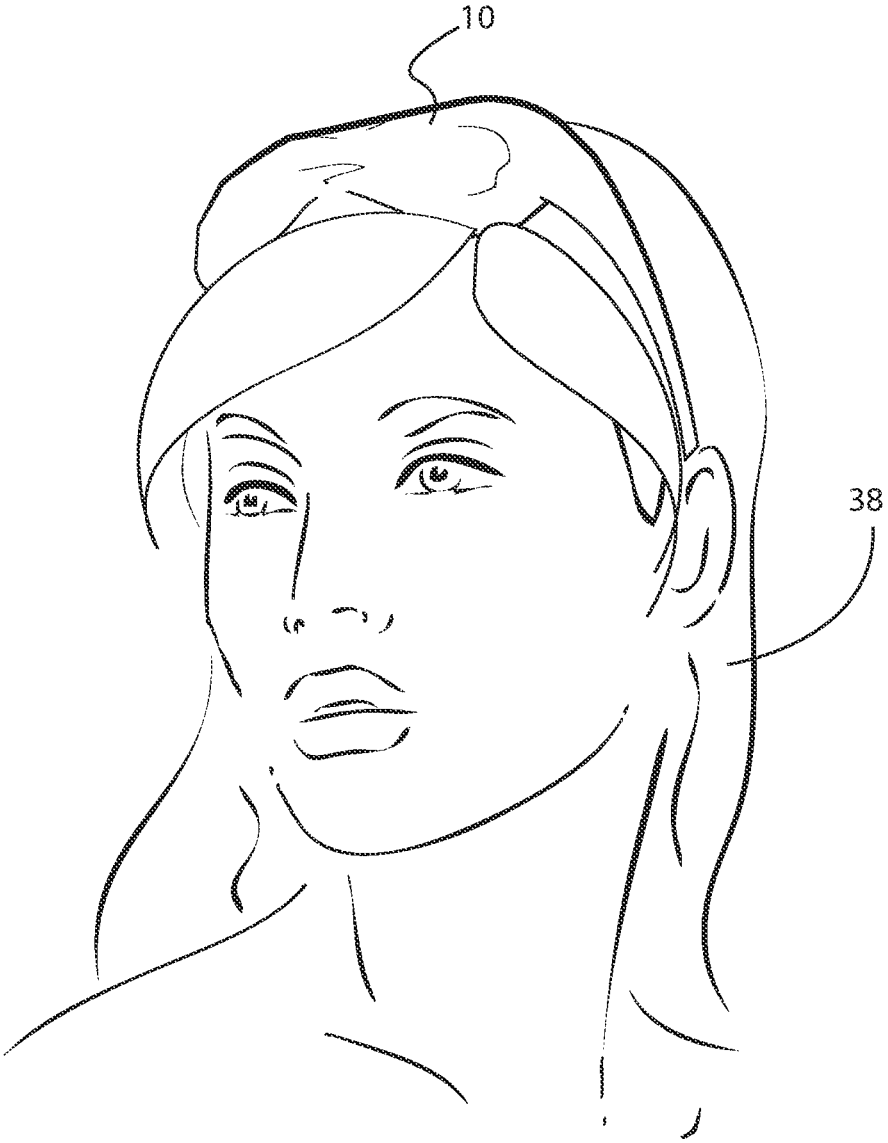
FIG. 6 is a view of the glasses cover being worn.

FIG. 3 shows one embodiment of the cover. FIG. 4 shows the cover with a pair of sunglasses inside of the cover. FIG. 5 is another view of the cover, with a detailed view of the flap. FIG. 6 shows the cover and glasses being worn in a headband style.

Figure 9:
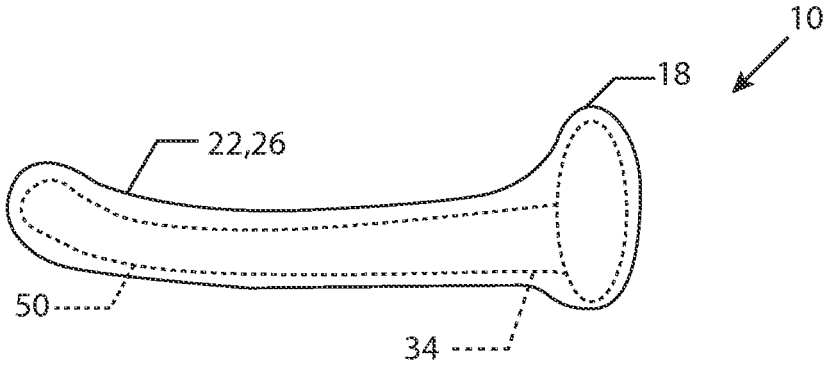
FIG. 9 is a side view of an embodiment of the glasses cover.

FIG. 9 shows a side view of the cover 10 with a pair of glasses 34 inside the cover. In this embodiment, the stem portions 22, 26 generally cover the entire stem 50 of the glasses 34.

Figure 10:
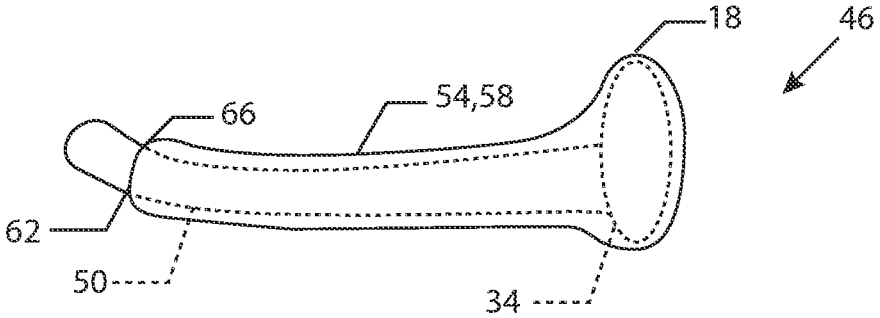
FIG. 10 is a side view of another embodiment of the glasses cover where the stem portion only covers a majority of the glasses' stems.

FIG. 10 shows another embodiment of the cover 46 which has stem portions 54, 58 (58 not visible in this view) that do not completely cover the stems 50. In this embodiment, the distal ends 62 of the stem portions 54, 58 has an opening 66 for the distal ends of the stems 50 to protrude from.

Figure 11:
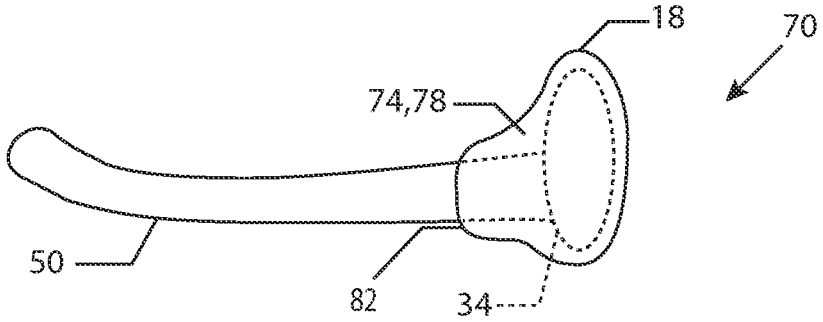
FIG. 11 is a side view of another embodiment of the glasses cover where the stem portion only covers a small portion of the glasses' stems.

FIG. 11 shows another embodiment of the cover 70. In this embodiment the stem portions 74, 78 of the cover 70 are very short such that nearly the entire length of the stems 50 extend from an opening 82 in each of the stem portions 74, 78.

Figure 12:
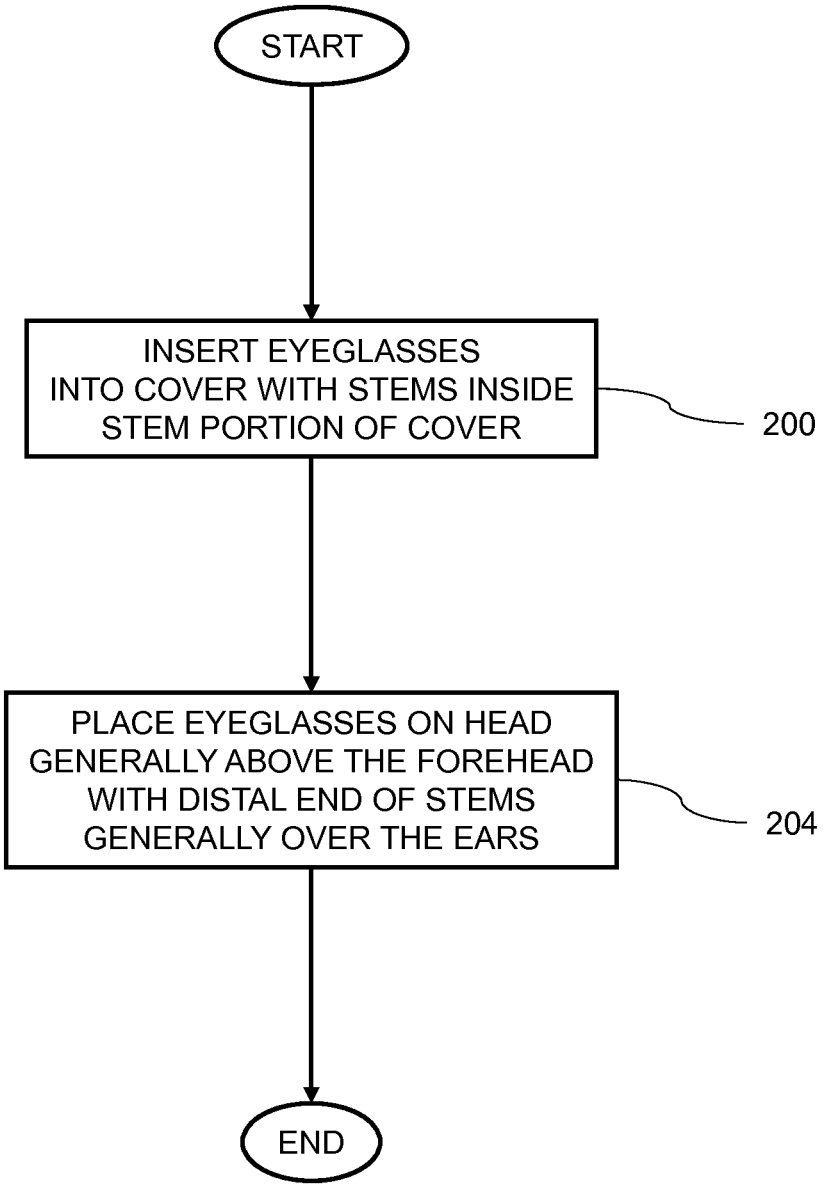
FIG. 12 is a flowchart showing a method of the invention.

FIG. 12 shows a method of using the cover. At act 200, the user inserts his or her glasses into the over, with the stems inside the stem portion of the cover. Depending on the embodiment of the cover used, the stems of the glasses may be completely enclosed in the cover, or partially extend from the cover, or mostly extend from the cover. At act 204, the user places the glasses on his or her head generally above the forehead, with the stems of the glasses over the ears, such that the cover and glasses look and act as a headband.

Figure 13:
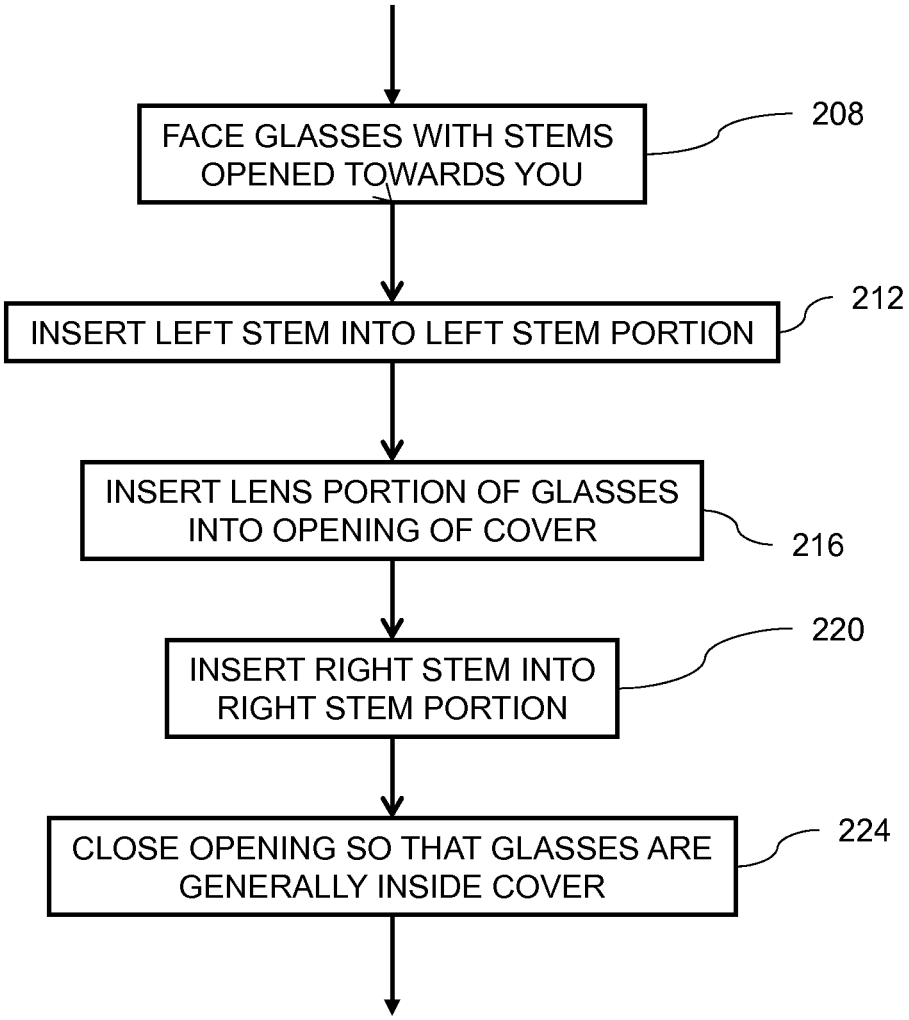
FIG. 13 shows another embodiment of the method of the invention.

FIG. 13 shows one embodiment of the acts that may make up act 200 from above. At act 212 one inserts the left stem of the glasses into the left stem portion of the cover. At act 216 one slides the lens portion of the glasses into the opening of the cover. At act 220 one inserts the right stem portion of the glasses into the cover. At act 224 one closes the opening so that the glasses are generally inside the cover.

Figure 14:
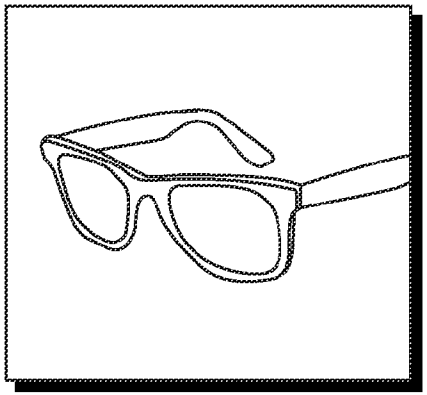
FIG. 14 shows a pair of glasses.
Figure 15:
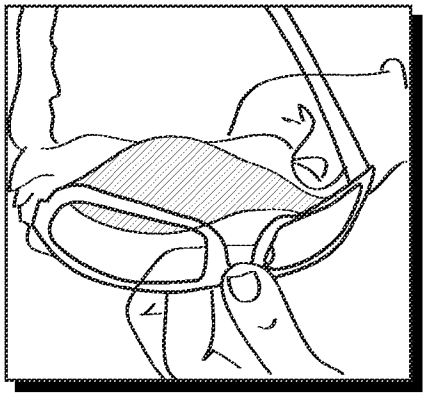
FIG. 15 shows a user putting the left stem of the glasses into the left stem portion of the cover.
Figure 16:
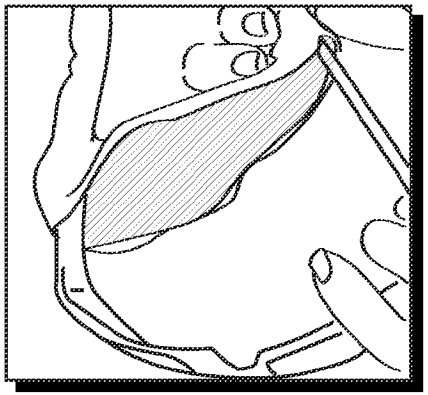
FIG. 16 shows one sliding the lens portion of the glasses into the opening of the cover.
Figure 17:
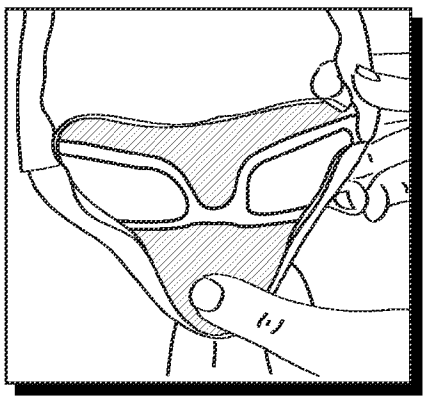
FIG. 17 shows a user inserting the right stem portion of the glasses into the right stem portion of the cover.
Figure 18:
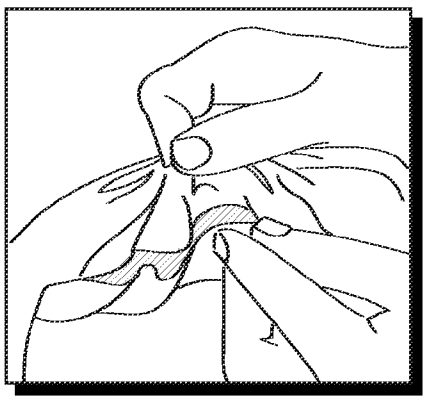
FIG. 18 shows the user closing the opening so that the glasses are generally inside the cover.
Figure 19:
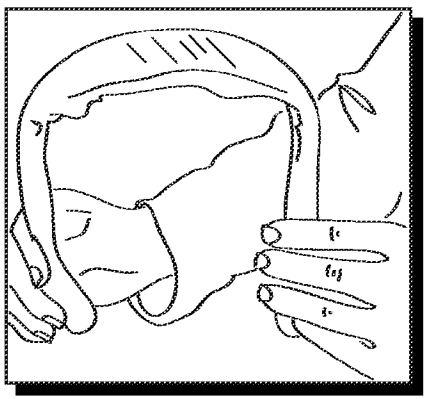
FIG. 19 shows the glasses fully inserted into the cover.

FIGS. 14 through 19 shows the steps from FIG. 13. FIG. 14 shows a pair of glasses. FIG. 15 shows a user putting the left stem of the glasses into the left stem portion of the cover. FIG. 16 shows one sliding the lens portion of the glasses into the opening of the cover. FIG. 17 shows a user inserting the right stem portion of the glasses into the right stem portion of the cover. FIG. 18 shows the user closing the opening so that the glasses are generally inside the cover. FIG. 19 shows the glasses fully inserted into the cover.

This invention has the advantages of looking more stylish than simply wearing your sunglasses (or glasses) on top of your head; it protects the lenses of the glasses from scratches, and allows for quick removal of the glasses from the sleeve when the user needs to put on the glasses. The invention may lift the user's hair for a more stylish look. Prevents the user's hair from being snagged in the glasses. Protects glasses from hair products which could damage the glasses. The invention can act as a carrying case for the glasses. The cover is washable. The invention can be worn on the ankle or wrist as a wristlet.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A headband cover and a pair of glasses, the headband cover comprising:

a sleeve, the sleeve comprising:

a main body portion for enclosing the lens portion of the pair of a glasses, the main body portion having a height $H_B$;

a first stem portion for receiving and completely enclosing the first stem of the pair of glasses, the first stem portion having a height $H_{SP}$;

a second stem portion for receiving and completely enclosing the second stem of the pair of glasses, the second stem portion also having a height $H_{SP}$;

an opening located in the main body portion for receiving the pair of glasses;

wherein $H_B$ is greater than $H_{SP}$; and wherein the sleeve is configured to be able hold the pair of glasses in an unfolded orientation with the lens portion in the main body portion, the first stem in the first stem portion, and the second stem in the second stem portion.

2. The headband cover and the pair of glasses of claim 1, further comprising an attachment means on the main body portion configured to close the opening.

3. The headband cover and the pair of glasses of claim 1, wherein the opening is a flap.

4. A headband cover system, the system comprising:

a pair of glasses;

a sleeve, the sleeve comprising:

a main body portion, the main body portion sized to generally be able to enclose the lens portion of the glasses, the main body portion having a height $H_B$;

a first stem portion, the first stem portion configured to completely enclose the glasses' first stem, the first stem portion having a height $H_{SP}$;

a second stem portion, the second stem portion configured to completely enclose the glasses' second stem, the second stem portion having a height $H_{SP}$, and where $H_B$ is greater than $H_{SP}$;

an opening located in the main body portion and configured to allow entry and exit of the glasses with respect to the cover; and wherein the sleeve is configured to be able hold the pair of glasses in an unfolded orientation with the lens portion in the main body portion, the first stem in the first stem portion, and the second stem in the second stem portion.

5. The headband cover system of claim 4, wherein when the glasses are inserted into the sleeve and the sleeve is removeably attached to a human head generally above the forehead, with the stems of the glasses over the ears, the sleeve and glasses look and act as a headband.

* * * * *